United States Patent [19]

Espinos Guerrero

[11] 4,206,678

[45] Jun. 10, 1980

[54] INTRODUCED IN THE MECHANICAL AND FUNCTIONAL STRUCTURE OF STRINGED INSTRUMENTS

[76] Inventor: Antonio Espinos Guerrero, Po de la Habana, 204 Madrid, Spain

[21] Appl. No.: 910,949

[22] Filed: May 30, 1978

[30] Foreign Application Priority Data

Nov. 29, 1977 [ES] Spain ..... 464.582
Dec. 27, 1977 [ES] Spain ..... 465.484

[51] Int. Cl.[2] ..... G10D 3/00

[52] U.S. Cl. ..... 84/267; 84/275; 84/291

[58] Field of Search ..... 84/274, 275, 291, 267, 84/290

[56] References Cited

U.S. PATENT DOCUMENTS

| | | | |
|---|---|---|---|
| 476,907 | 6/1892 | Tibbits | 84/275 |
| 1,116,754 | 11/1914 | Storle | 84/291 |
| 1,128,217 | 2/1915 | Bohmann | 84/295 |
| 1,214,075 | 1/1917 | Rice | 84/295 |
| 1,317,089 | 9/1919 | Maine et al. | 84/275 |
| 1,890,861 | 12/1932 | Overton | 84/267 |
| 2,473,980 | 6/1949 | Willner | 84/275 X |
| 3,853,031 | 12/1974 | DeWitt et al. | 84/267 |
| 4,026,181 | 5/1977 | Barcus et al. | 84/291 |

*Primary Examiner*—Lawrence R. Franklin
*Attorney, Agent, or Firm*—Wenderoth, Lind & Ponack

[57] ABSTRACT

An improvement in the mechanical and functional structure of stringed instruments, tending to obtain perfection in the sound of guitars, violins and other instruments of this type, comprises arranging in the interior of the sound box of the instrument an arrangement which diminishes, cancels and even produces a contrary effect to that originated on the sound box by the tightening of the tuned strings and by the force of sound derived from the vibration thereof. Such arrangement has an adjusting element, preferably arranged on the outside, which controls the adjustment of the assembly, in order to obtain an optimum sound of the instrument.

3 Claims, 14 Drawing Figures

INTRODUCED IN THE MECHANICAL AND FUNCTIONAL STRUCTURE OF STRINGED INSTRUMENTS

BACKGROUND OF THE INVENTION

The present invention consists of improvements in the mechanical and functional structure of stringed instruments, tending to achieve a perfection of the sound produced thereby and, preferably, designed to modify the structure of violins and guitars presently made according to conventional techniques.

Violins and all musical instruments of the same family include those in which the musical sound is obtained by making the four strings of the instrument vibrate by means of a bow. Guitars, on the other hand, consist of a set of strings mounted on a wooden box which has an almost closed air space. Some force of the vibrations generated when the strings are played upon with the fingers is communicated to the box and to the air space in which the corresponding vibrations are established. These, in turn, make the air between the instrument and the listener vibrate, in other words, they produce sound waves which reach the listener. The sound of a guitar, aside from the acoustics of the site where the instrument is being held and the skill of the artist, depends on the vibration transfer from the strings to the sound box and, in turn, therefrom to the air.

It is known that the best violins existing presently are those which were made at the end of the eighteenth century by Antonio Stradivari and by Guarneri, their models having gone done in history, and which today have not been bettered. A similar thing happens in the construction of guitars where the manufacturers, due to the special sensitiveness thereof, achieve therewith highly tuned and perfect sounds. However, this constructive technique is based, both for violins as well as for guitars, on the special knowledge the manufacturers have of the subject and not on well defined principles or laws. Therefore, the quality of the instrument is not known until it is finished. Thus, after the manufacturing process, if the instrument had a relatively deficient sound, there was no process by which the acoustic conditions thereof could be improved, and a new instrument had to be made.

SUMMARY OF THE INVENTION

The object of the present invention is to solve this problem by proportioning a series of physical means whereby the parameters intervening in the acoustic conditions of the instruments are corrected. For a better understanding of the invention, a brief description of the intrinsic constitution of stringed instruments to which the present invention refers, preferably violins and guitars, will be made.

The sound box of a violin is formed of a front plate and a posterior plate, both slightly arched outwardly, giving rise to a very wide bell shape with support frames at its sides. The posterior cover is hand-carved, with a chisel, a brush, and a scraper and is generally made of an air-dried maple block, although pear or sycamore wood is also sometimes used. Normally, in better quality violins, this cover is constituted of a single piece, although there are other makes comprising two carefully joined pieces. The thickness there-of is variable, from about 6.5 mm in the center to about 2 mm at the edges.

A detailed physical study of the forces acting in the acoustic functioning of a violin and which condition the result of a good or a bad sonority, points to the tension existing in the strings of the violin as the main factor, which strings, acting with a K force, transmit to the upper cover of the violin, through the bridge thereof on which they are supported, an F force which is decomposed into two forces, $F_1$ and $F_2$, which act directly on the upper cover of the violin, through two supports by which the bridge is fixed thereto. Forces $F_1$ and $F_2$ produce a permanent deformation of the upper cover, having a standard value in the range of 6 Kgs. per each force, which deformation is counteracted by means of the incorporation in the interior of the violin of elements known as a soundpost and a low-tone bar, constituting the mechanical solution which maintains the deformation of the upper cover within acceptable limits for an optimum sound.

The soundpost of the violin prevents an apparatus deformation of the upper cover from taking place, inasmuch as, since it is pushed with a force of about 6 Kgs. which it transmits to the lower cover, such force will be absorbed between both covers and the soundpost. However, this does not take place with the low-tone bar, which has been incorporated to increase the inertia of the upper cover in this zone and for the deformation produced to be acceptable, with the understanding that there will always be some deformation since this is inversely proportional to the moment of inertia which, in turn, depends on the thickness of the plate. Thus, a plate having an infinite thickness should be incorporated so that no deformation takes place, which is, from all points of view, unfeasible.

The object of the aspect of the present invention directed to bettering the acoustic conditions of violins thus resides in obtaining a device which eliminates, in the proper amount, the effect of the tension of the strings, even cancelling such effect, which device is operated at the will of the user, whereby a change of the frequencies inherent in the upper cover will be obtained. Therefore, in fact a variable-frequency violin the sonority curve of which can readily be varied according to the required needs is obtained. Consequently, instruments having a sound as good as the best are achieved, thus eliminating the random factor with which the manufacturers of this type of instruments have heretofore been faced.

This same factor dominates the spirit of the invention when applied to guitars and other instruments of the same family, in spite of the different characteristics existing between the guitar and the violin. Therefore, it is necessary to make a short description of the intrinsic composition of guitars and of the dynamics of their component parts during operation thereof.

As is known, the materials forming part of a guitar are the following:

Six nylon measured and stretched strings, three of which are twisted.

Two thin wooden plates, flat and having a like thickness throughout their length which, joined by another piece of wood, form the harmonic box.

A diapason which comprises the pegs to tighten the strings.

A bridge on top of the upper cover to fix the strings subjected to tightening.

Finally, and likewise made of wood, in the posterior part of one of the covers, there is a series of pieces known as a "fan", formed of thin strips of wood fixed below the upper cover and extending from the opening thereof, known as the mouth, to the lower end. Without such mouth the guitar cannot sound. Therefore, this fan constitutes a very important element in the production of guitars, improving the tone of the instrument, which can be substantially varied by slightly changing the position in which the fan is arranged, the acoustic function of which has been the object of study for many years.

Since the strings of the guitar are subject to tightening, it is assumed that the resultant of all of the strings creates a force F applied to the bridge of the guitar which is not at the same level as the upper cover, creating therefore a resultant moment thereon. The bridge subjected to such tension should always have some movement so as to resist the tensional force of the strings. However, in its contact with the upper cover its movement is practically nil, presenting, therefore, a horizontal axis on which the complete bridge together with its support turns, deforming the upper cover of the guitar, according to the performance thereof which has schematically been represented in FIG. 1 of the drawings.

The strings, since they vibrate, disturb the circulating air according to a great number of energy-given harmonies which decrease as the frequency increases, the wooden box forcing each one of the frequencies present to vibrate at a particular rate and depending on the vibration amplitude of the driving force. Since the structure of the wood itself has a multitude of frequencies, in the event that the resonance frequency of the wood coincides with the harmonic frequency of the string, an increase in the energy transfer will take place from the string to the box and a greater amplification of the tone. However, this will not occur if the natural frequency of the wood does not coincide with the frequency of vibration of the string, a fact which takes place constantly. And although the guitar manufacturer has a greater interest in and a knowledge of this resonance of the wood, due to the complexity of the subject, he can only take as a suitable guide the lowest resonance, known as the main resonance. Another important factor in the sonority of a guitar is the lowest natural frequency of the air enclosed within the space of the sound box, which is known as the main resonance of the air. This frequency of the sound of the air can be controlled by the volume of air enclosed in the box of the instrument and by the surface of the circle of the mouth, so that the greater the volume of air the lower the frequency. The frequency becomes higher as the diameter of the mouth increases.

The sonority curve of a guitar can be represented on a sound meter. One of the axes of the curve represents a sound measurement in decibels which, in short, is a level of acoustic pressure, while the other axis represents the musical intervals corresponding to the tuned strings of a guitar.

For a better understanding of how the sonority of a guitar can vary during construction, depending on the constitution thereof and on the materials used, FIG. 2 of the attached drawings illustrates the standard sound curves for three different guitars. FIG. 2A represents the sound curve of an excellent handmade guitar, FIG. 2B corresponds to the sound curve of an average type guitar, and FIG. 2C illustrates the sound curve of a mass-produced guitar having a poor quality.

From a mere observation of these figures it can be seen that FIG. 2A illustrates the main resonance of the wood represented by the dots 1 and that of the air represented by the dots 2, which are separated in approximately a fifth, that is to say, seven semi-tones which is one of the main characteristics of a good guitar. The space represented is the optimum and the force of the wood is rather acceptable, in line with the resonance of the air. The resonance areas of the wood formed by the descending curves with a maximum in its major resonance, exceed the area of the resonance of the air in small proportions, that is to say, there is an equilibrium.

However, in the curve of FIG. 2B, the main resonance of the wood and that of the air are separated in a major musical interval, giving two strong resonance areas for the wood with a poor resonance field between them which corresponds to the air.

The curve of FIG. 2C, which corresponds to a very poor quality guitar, besides the separation between its main resonances, of wood and air in more than one eighth, twelve musical intervals, illustrates a substantial air resonance area, the wood contributing practically very little in the form of a resonant reinforcement.

Accordingly, the quality of a good guitar, when finished, can be approximately known if it is known where the resonances should be found, that is to say, that of the wood and that of the air. The question which immediately arises is, how are these objectives attained during the manufacturing process so that a guitar will have the desirable resonance conditions?

In any case, to make a guitar having a good sound, the frequencies of the front and the lower cover should be determined in order to correct them, reducing them if necessary in some points, so that the frequencies of both may comply with the conditions inherent in a good stringed instrument. This solution, so simply explained, becomes more complicated in the guitar since the front cover incorporates the fan, so that the tension of the strings which produces a moment in the cover can be supported by the cover without any kind of permanent deformation. In short, the fan increases the inertia of the cover which has to vibrate. Therefore, if the cover should be reduced to vary the frequency, operation is taking place in an opposite direction, on diminishing the inertia, since this would produce a more pronounced permanent deformation, with a worse sound due to an imperfect vibration of the upper cover.

Consequently, the mentioned fan has two contradictory qualities. On the one hand, although it is suitable to support the tension of the strings, it need not be so to mark a convenient frequency at a lesser thickness, this resulting in a randomness in guitars where, although likewise constructed, some are better than others with respect to their sonority. Therefore, the fan necessary in the guitar poses many problems resulting in guitars likewise constructed having unlike sonority curves.

Due to these facts, it seems that the most recommendable course of action is to reconsider the construction of the fan, its function, etc., and, in an attempt to comply with the object for which it was created, to replace it with other forms and arrangements which solve the problem but which do not interfere with the sound which should be perfectly produced by the guitar. Thus, it is convenient to make a study of the forces acting on the set of strings of the guitar, all of which are subjected to the tuning tension thereof:

| Strings | Kg. tension × $L^2$ | L = 66 cm |
|---|---|---|
| 1 | 18.215 | 8 Kg. |

-continued

| Strings | Kg. tension × $L^2$ | L = 66 cm |
|---|---|---|
| 2 | 13.764 | 6 Kg. |
| 3 | 13.627 | 6 Kg. |
| 4 | 16.276 | 7 Kg. |
| 5 | 14.289 | 6 Kg. |
| 6 | 14.121 | 6 Kg. |
| Total | 90.292 $L^2$ | 39 Kg |

These are approximate figures, since they depend on the unit weight of the strings which is variable, logically, for each string and on the quality thereof, the figures, therefore, only serving to explain the dynamic phenomena produced in the guitar, when used.

This is the tension of the strings statically which, when touched with the fingers and with a margin, could be increased by about 3 Kgs. which, for safety purposes, shall be taken as 5 Kgs. In this way, a total tension of 44 Kgs. is obtained, 39 Kgs. corresponding to the tension of the strings at rest, and 44 Kgs. on increasing string tension by 5 Kgs. when played.

The point of application of the resultant of all these forces is determined by means of a funicular polygon. A funicular polygon has to be made for each string which is played to which are added, besides the static tension, 5 Kgs. which represent the dynamic tension of touch. FIG. 3 of the attached drawings represents all the funicular polygons of this type, illustrating the resultant, in each case, between the third and fourth strings. Therefore, if the centre of the bridge is taken as the point of application of all the forces, the approximation is more than sufficient for these purposes, since the separation between strings is scarcely one cm. Thus, the error in the application, as can be seen in the drawing, can be due to a lack or an excess of a few millimeters.

The deformation produced in the upper cover without the fan can be calculated, in an unfavourable hypothesis, as if it were a plate having a length of 30 cm., which is the distance from the lower end to the mouth, a width of 24 cm., which is approximately the width of the neck, and a thickness E. The deformation to be suffered will be similar and close to that represented in FIG. 1, the maximum whereof will be at ⅓ of the length AB starting from A.

The maximum deformation is given by the equation:

$$\max = \frac{M}{4\,EI} \cdot \frac{L^2}{9}\left(\tfrac{2}{3} - \tfrac{1}{2}\right) = \frac{M \cdot L^2}{216\,EI}$$

E=elasticity coefficient of the wood
I=moment of inertia of the section $$\max = \frac{1 \times F}{216\,E} \times \frac{30^2}{1/12 \times 24 \times e^3}$$

Since this studied case is somewhat more unfavourable than the real case in which for a normal thickness of 0.22 cm. the permanent deformation obtained will be of approximately 0.07 cm., such figure should be reduced since the cover is fixed in its edge. Thus, 0.5 mm should be taken as the approximate figure per maximum deformation. The greater part of this deformation should be absorbed by the fan which, in short, increases the inertia of the upper cover. However much the inertia is increased, there will always be a permanent deformation which, undoubtedly, will become so slight that it could be ignored because it does not disturb, inasmuch as cancellation is impossible since the inertia should be infinite.

It can be seen at first sight that the fan formed by wooden strips in a more or less radial manner from the mouth to the bridge does not correspond mechanically to the best way to solve the deformation, since it can more or less be seen, exactitude how this deformation should take place, i.e. longitudinally, as represented in FIG. 1, with its maximum at ⅓ from the lower bridge, and transversally according to the same figure.

If the point indicated as the maximum deformation were increased by one mm. and this point were taken as the vertex of a cone whose base is the contour of the guitar comprised of a horizontal along the bridge and another along the lower end of the mouth, profile of the upper cover, very close to the most adequate, will be obtained, with a maximum permanent deformation smaller than one tenth of a millimeter, which possibly, is not an excessive deformation. This feature can be seen graphically in FIG. 4 of the attached drawings. Likewise, this should be made in the upper cover from the bridge to the end of the harmonic box but on the obverse face. Thus, such feature is illustrated in FIG. 5.

Theoretically, this is the best fan which can be made, that is to say, with a four mm. piece of wood which is reduced as illustrated in the figure, a better result will probably be obtained than with the fan presently used. A two mm. central grain having a slightly raised figure, less than one mm., will be obtained, both on the reverse of the upper cover, from the bridge to the mouth, as well as the obverse, from the bridge to the end of the box.

Now then, a question immediately arises. If the fan did not exist, the permanent deformation would be about ½ mm. at the top and at the bottom of the upper cover. What permanent deformation would be acceptable? What magnitude of the deformation should the fan absorb due to the increase in the inertia of the cover? It is impossible to known this and to set norms. The random factor is the guide, depending on the quality of the wood, which gives, consequently, the difference in sound in guitars similarly constructed.

Summarizing the aforegoing, the following conclusions are arrived at:

(a) The sonority curve of a good guitar should be produced by separating the main resonance of the wood from that of the air in a fifth, that is to say, seven semitones.

(b) The areas left by the sonority curve formed by the descending parts thereof with its maximum in the main resonance of the wood, should be counteracted by those of the resonance of the air of the harmonic box.

(c) the "tape-tones", that is the sounds registered on the basis of small blows, should be produced so that the high resonance points of the upper cover may vary with those of the lower cover, while the adjacent high points are situated at a half-tone from one another.

(d) The "tape-tones" of the upper cover are substantially modified as the inertia thereof is increased due to the construction of the fan, to support the tension of the strings with an acceptable deformation.

A more complex problem arises which is difficult to overcome, even by using the best mechanical knowledge of making standard guitars with the same pattern, since what cannot be corrected a priori is the quality of the wood, because, as has been seen, due to the incorporation of the fan there are two contradictory effects.

Therefore, a random solution should be accepted, which will give variable results, sometimes better and other times worse, within a range of qualities which, in handmade guitars, are good but not homogenous. Thus, only some guitars can be classified as superior.

To overcome this problem the possible solutions should depart from the causes producing the effects, to act on those causes which give logical results and in accordance with the results to be reached. The solutions proposed by the present invention, with respect to guitars, are the following:

I. The tension produced in the strings so that they can sound in each note according to the vibration to be produced, gives rise to a moment in the centre of the upper cover which produces a permanent deformation effect becoming a serious obstacle imperfectly and only partially overcome with the fan. Thus, by creating a device which produces a moment, adjustable at will but in a direction opposite to that produced when the guitar is played, the problem would be solved, since the moment which causes so many difficulties could be cancelled.

II. The moment produced by the tension of the strings gives rise to a permanent deformation. By creating a device, adjustable at will, which produces a deformation at the same point but in the opposite direction, such deformation could be cancelled and even, if desired, can be carried out by producing deformation in the opposite direction, in search of an equilibrium when the guitar is played.

Both devices, that which acts on cause I and that which acts on cause II, adjusted by the guitarist, will give rise to an improvement in the quality of the sound in such a significant way that it will make guitars, similarly constructed, homogenous, eliminating almost totally the random factor previously mentioned.

In both the mentioned solutions, to the reverse of the upper cover of the guitar including its bridge but not a fan, there is attached a new bridge fastened similarly and at the same height or higher.

BRIEF DESCRIPTION OF THE DRAWINGS

Having made these preliminary remarks in connection with the component parts and the acoustic functioning of guitars and violins, a more detailed description will be made of the features of the present invention, with reference to the attached drawings, wherein, by way of illustration and not limitation, the following is represented.

DETAILED DESCRIPTION OF THE INVENTION

Figure 6:
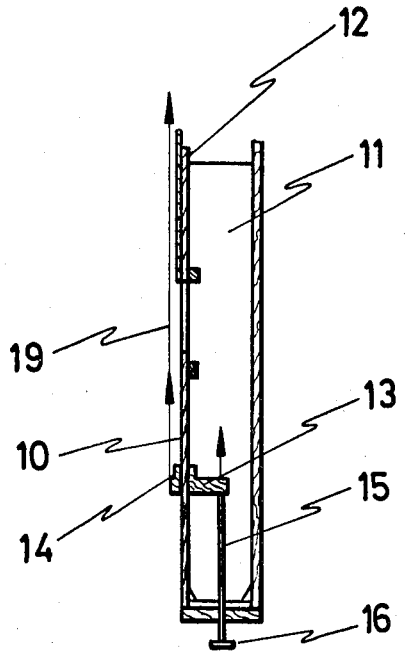
FIG. 6 is a schematic view of the fixed device, derived from the present invention, applied to a guitar, to give rise to a variable reaction on the upper cover thereof, the variation of the sonority curve of the instrument being achieved at will.

In any of the embodiments of the invention, the mechanical and functional structure of stringed instruments is improved by introducing a device for varying at will the dynamic effects which take place on the upper cover or bridge of the instrument due to the force communicated by the vibration of the strings thereof. The device, which is illustrated in FIG. 6, consists of superpositioning on the inner face of the upper cover 10 of the acoustic box 11 of a guitar 12 an inner or auxiliary bridge 13 arranged opposite to the original or normal bridge 14 incorporated in the guitar and on which the strings 19 thereof are supported. The maximum height of this piece 13 cannot exceed the height of the harmonic box wherein the original bridge 14 is housed. The greater the height the smaller the force necessary to counteract the tension of the strings. A rod 15 will act on piece 13 to impart an auxiliary tension force thereto, which rod, controlled by the conventional device 16, produces a moment in the upper cover 10 in a direction opposite to that which takes place in the bridge 14 to which the tightened strings are fixed. This rod 15, which can be a ruler made of wood or any other material, having a small section, closely adjusted between the inner bridge 13 and the lower end of the guitar, has to produce effects which are similar, but improved, to those of the fan, with the advantage that more suitable "tape-tones" will be obtained. However, in some cases, the vibration of the upper cover 10 may be affected somewhat during cleaning, since it depends on a small rigid structure.

Figure 7:
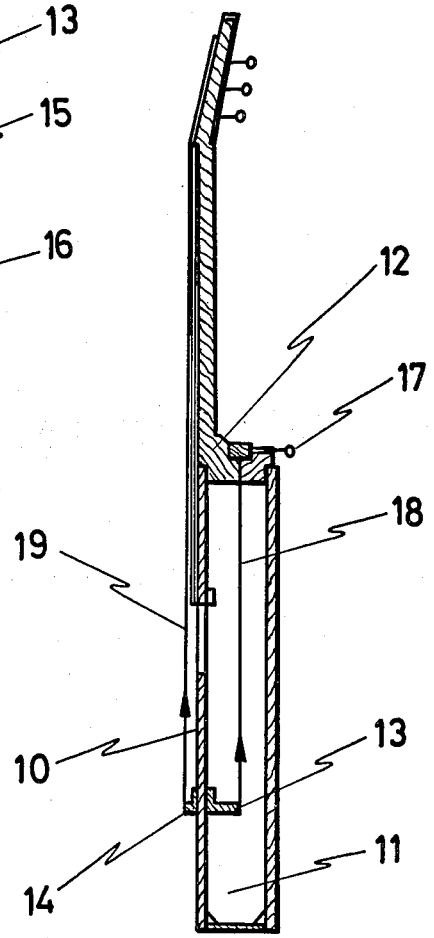
FIG. 7 is a section illustrating an improved embodiment of the device of FIG. 6, by which the effects obtained therewith are improved.

In an attempt to improve the previously mentioned device of FIG. 6, the device of FIG. 7 adds a seventh string 18 to the guitar, with the understanding that this new string 18 will not emit a sound. Thus, this new device, according to the invention, consists in acting on the previously described bridge 13 by means of a string 18 which is maintained under an auxiliary tension force by a conventional device 17 housed in the exterior of the sound box 11 of the guitar 12. The inner auxiliary bridge 13 should have the same characteristics as those mentioned for the prior device, that is to say, its height should correspond as a maximum to the height of the harmonic box in which the exterior bridge 14 of the guitar is housed, to which bridge 14 the strings 19, producers of the vibrations, are fixed.

Seventh string 18 can be tightened at will, so that the resultant auxiliary tension force produced; together with that of the other strings of the guitar, will fall on the middle grain of the wood of the upper cover 10. Thus, cover 10 will be in perfect equilibrium, without any permanent deformation and, consequently, will exactly fulfill the best conditions determined by the measurement and correction of frequencies of the "tape-tones", whereby the random factor of obtaining a better or worse sound will be completely eliminated.

Figure 8:
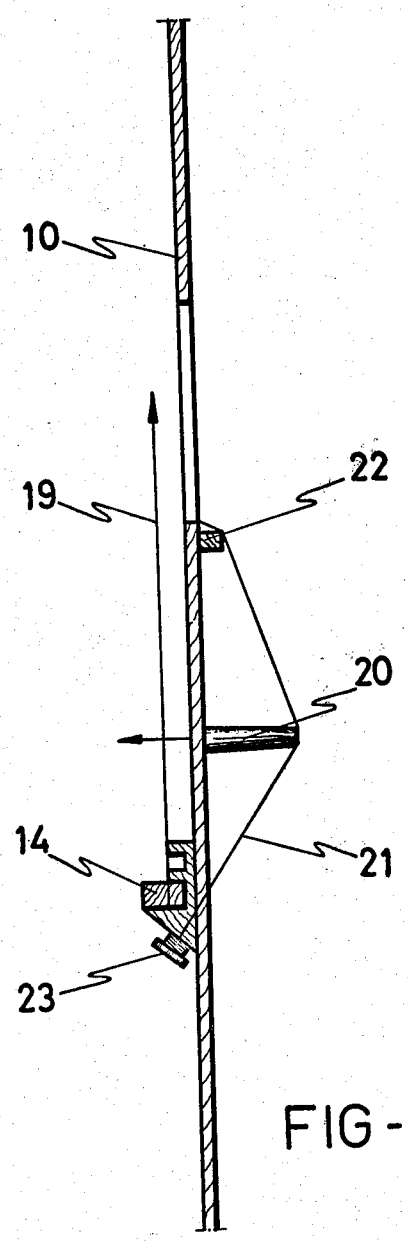
FIG. 8 is a schematic sectional view of a preferred embodiment of the present invention, applied to guitars.

Another embodiment comprised within the field of the invention is illustrated in FIG. 8 wherein the same results are obtained, that is to say, cancellation of the deformation to be produced by tightening the strings in the upper cover, and creating at will a deformation in the opposite direction which will cancel totally or partially that produced when the instrument is played. Negative values can even be obtained which increase the air space in the harmonic box. This device comprises a small portion 20 made of wood or other material situated at ⅓ of the distance from the lower bridge to the mouth, where the maximum deformation of the upper cover 10 is presumed to be situated. When tightening the seventh string 21 incorporated in the guitar, a compression is produced from the lower bridge 14 in wooden piece 20 whose reaction towards the upper cover 10 should produce, at will, a deformation in the opposite direction to that produced by the tightening of the strings 19, this being cancelled in the most suitable measure and in the most suitable magnitude until, when the tuned strings 19 are played upon, they emit the sound considered as optimum. It is not necessary in this embodiment to incorporate a new bridge 13, as in the prior embodiments, since only the original bridge 14 is necessary. It will only be necessary to incorporate in the interior of the upper cover 10 a fixing point 22 for the string 21 and a conventional tightening device 23.

Figure 9:
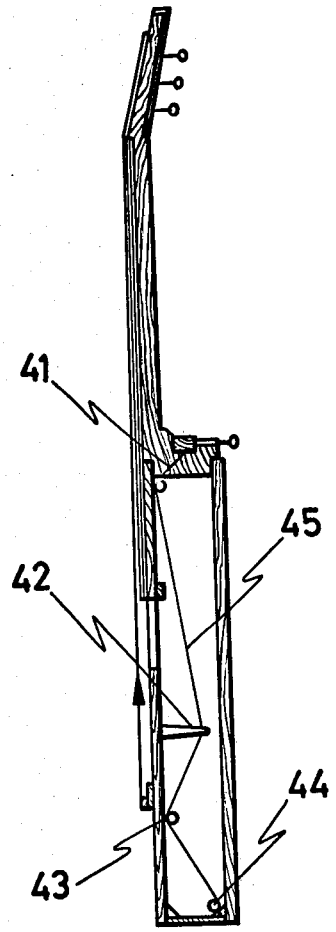
FIG. 9 is a section representing an improved and optimum embodiment of the device of FIG. 8 in which the ascending and descending deformations of the upper cover of the instruments are intervened.

To improve and increase the performance of the device of FIG. 8, another embodiment represented in FIG. 9 acts on the effects produced in the upper cover of the harmonic box by the dynamic of the touch.

This embodiment has, when compared with the former embodiment, the advantage that besides acting on the deformation of the upper cover towards the interior of the harmonic box, it also corrects the deformation thereof which is directed towards the exterior.

It is composed of a device, similar to that illustrated in FIG. 8, comprising a tightening device 41 for tightening a string 45 fixed to the opposite end of the harmonic box, at a point 44. String 45 has a polygonal path, due to a pivot 42 and a pulley 43. In this way, the tension of the string 45 is transmitted to its support points 42 and 43, according to different directions and magnitudes thus pushing the cover of the harmonic box outwardly by means of the pivot 42 and pulling it inwardly by means of the pulley 43, whereby the wavy movement undergone by upper cover 10 is eliminated.

The improvements introduced in guitars have been described heretofore. Therefore, it is necessary to define the modifications proposed by the present invention to the family of instruments pertaining to the violin, which, although they do not differ substantially from the solutions for guitars, vary with respect to the way in which they are applied and carried out.

Figure 1:
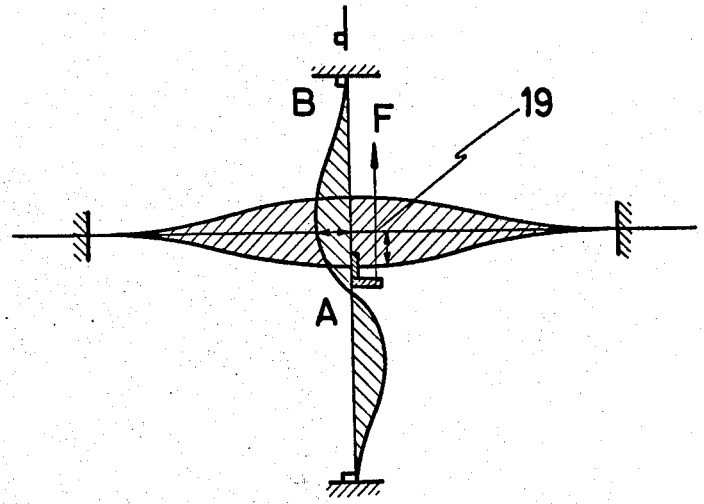
FIG. 1 is a schematic diagram of the deformation undergone by the upper cover of a guitar, when the strings thereof are played upon.
Figure 11:
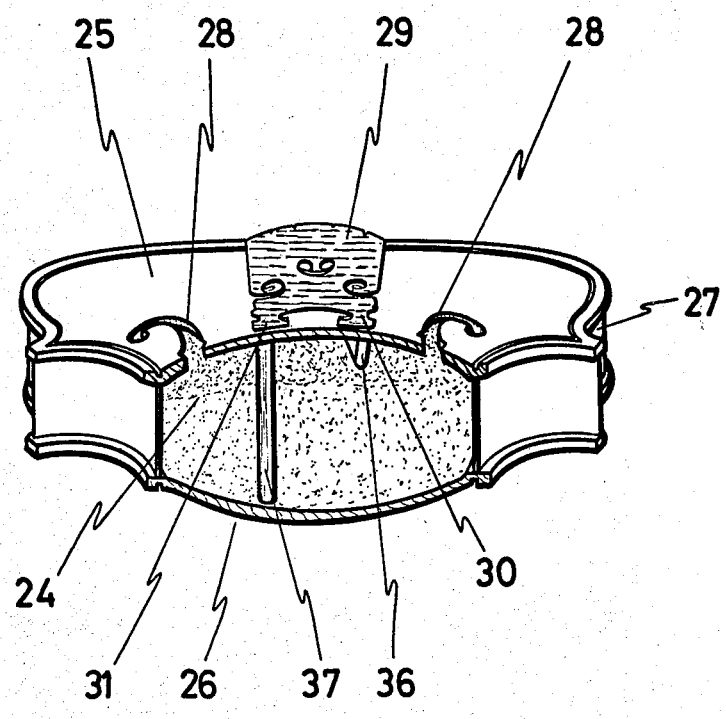
FIG-11 PRIOR ART
FIG. 11 is a cross-section of a violin, representing the various external and internal elements intervening in its sonority.
Figure 2A:
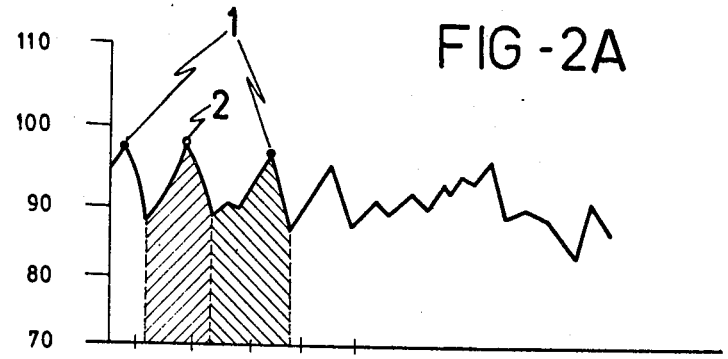
FIGS. 2A, 2B and 2C are graphs showing the different sonority curves of three guitars of very different qualities, the ordinate axes representing acoustic pressure levels, expressed in decibels, while the abscissa axes indicate the musical intervals which correspond to the strings of the tuned guitars.
Figure 2B:
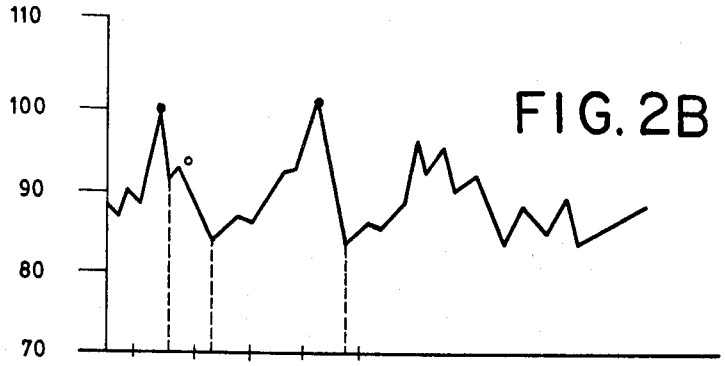
Figure 2C:
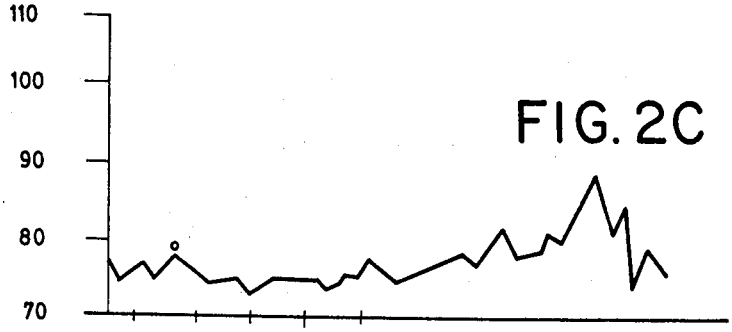
Figure 3:
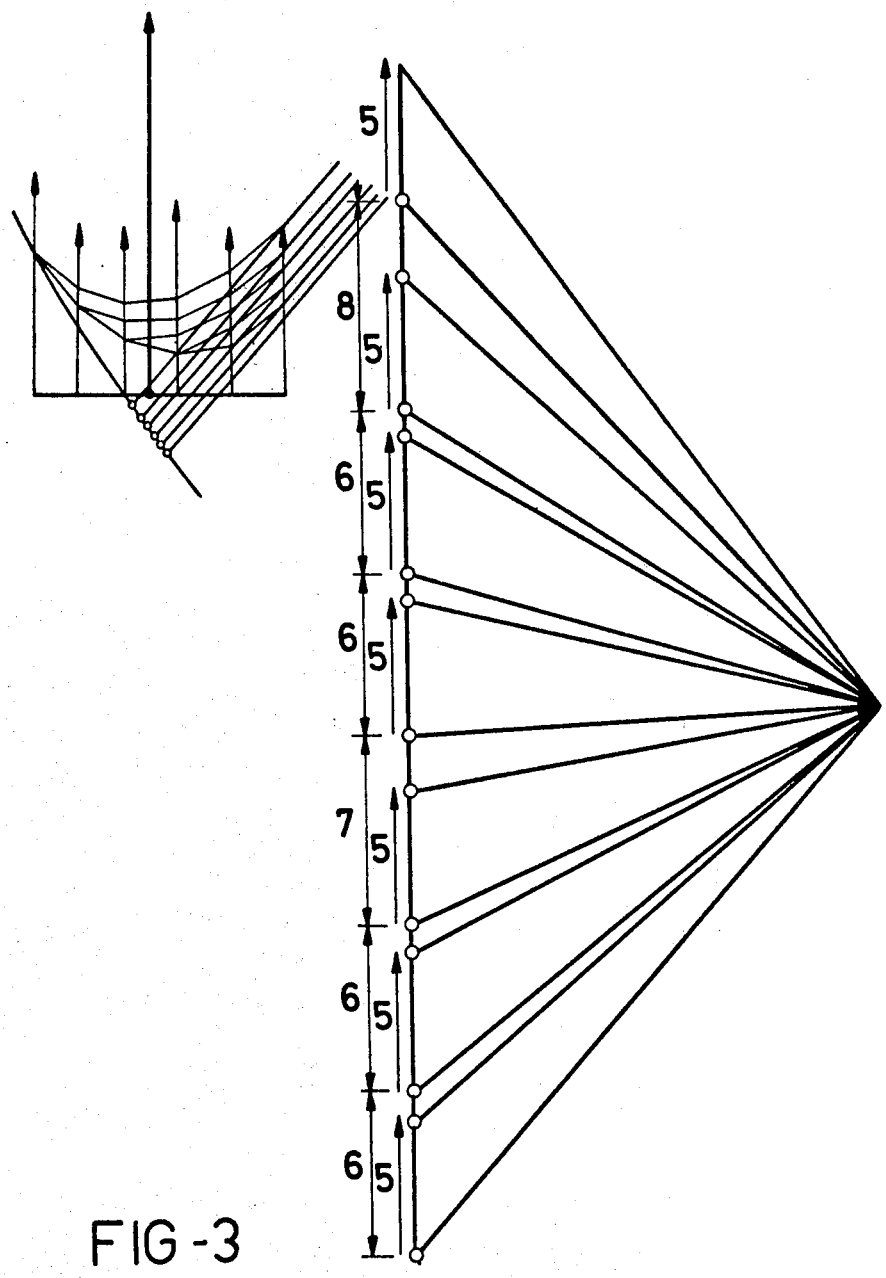
FIG. 3 is a graph illustrating the resultant of the forces acting on the bridge of the guitar by the strings thereof, which is determined by the different funicular polygons to which the force acting on each string gives rise.
Figure 4:
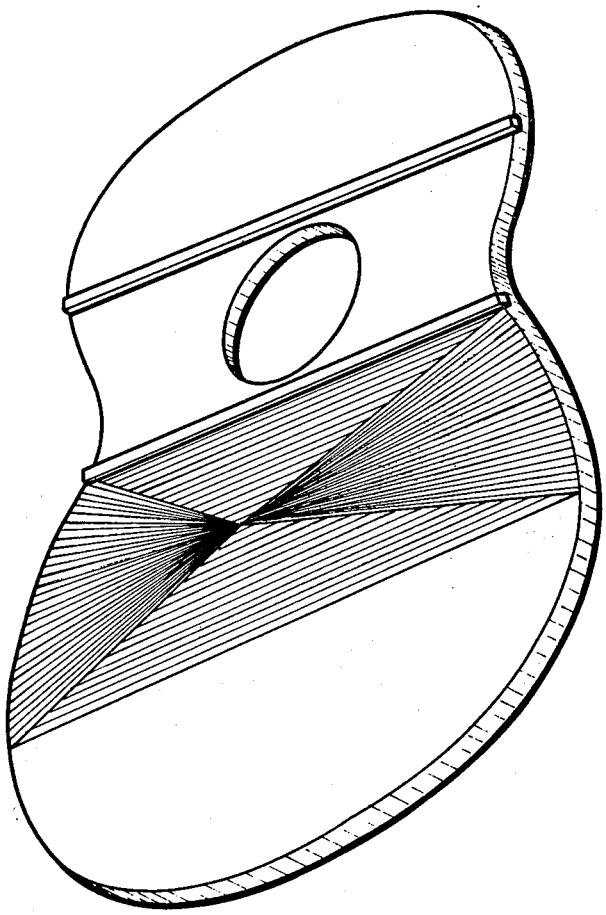
FIG-4 PRIOR ART
FIG. 4 is a perspective a view of the reverse of the upper cover of a guitar provided with a new design for the "fan" thereof.
Figure 5:
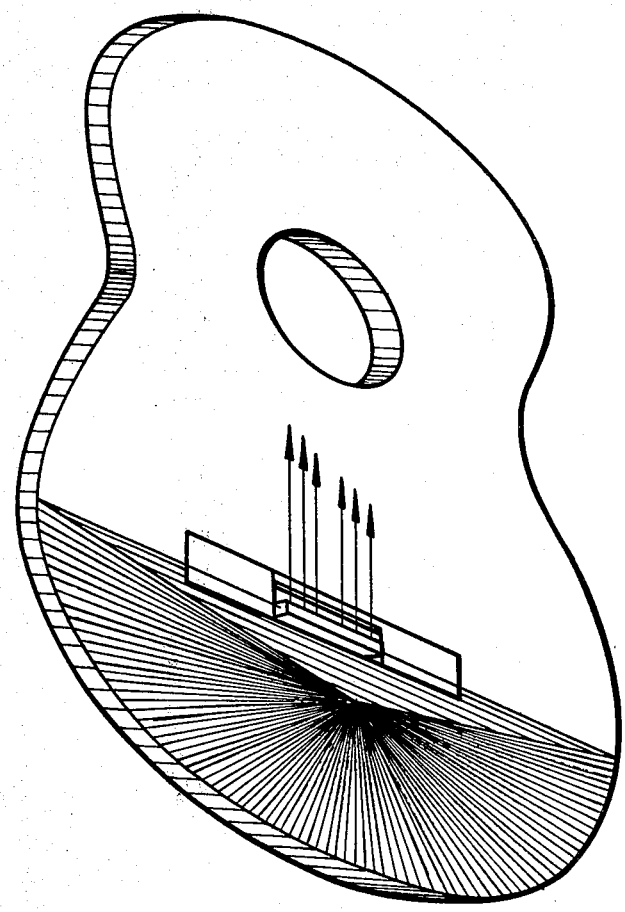
FIG-5 PRIOR ART
FIG. 5 is a perspective a view of the front of the upper cover of the guitar shown in FIG. 4.
Figure 10:
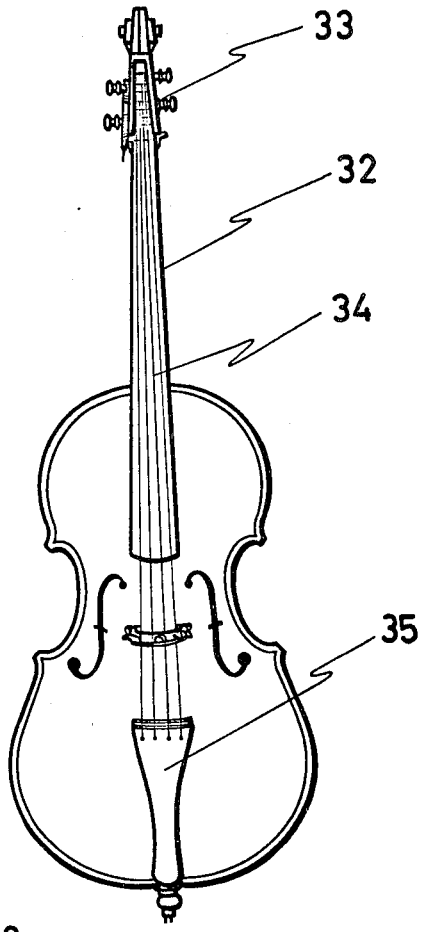
FIG -10 PRIOR ART
FIG. 10 is a plan view of a conventional violin, illustrating the various component parts thereof.

With respect to FIGS. 10 and 11, it can be seen that a conventional violin comprises a sound box 24 composed of an upper cover 25 and a lower cover 26 joined together by means of side or rings 27. The upper cover has S-shaped grooves 28 in the intermediate zone whereat there is situated the bridge 29 fixed to the upper cover 25 by means of supports 30 and 31. The neck plate 32 which ends in a pegbox 33 which provides tension to the four strings 34 of the violin, originates from sound 24. The upper cover 25, at its lower part, has a tailpiece 35 for fixing the four strings 34.

The combined tension of the four strings of the tuned violin, represents an amount close to about 30 Kgs., 40% of which, that is to say about 12 Kgs., is guided directly downwards through the bridge 29 and against the sound box 24, a force of about 6 Kgs. falling on each one of the supports 30 and 31 of the bridge of the very fragile upper cover. To distribute this load and to help the upper cover 25, which has an acceptable deformation, to support the downwardly component of the tension of the strings, a wooden strip 36 known as a "low-tone bar", since it is situated below the string having the lowest tone, is fixed below one of the supports of the bridge 29 and in the interior of the sound box 24.

The other support 31 of the bridge is fixed to the upper cover at a point below which there is a vertical cylindrical piece 37, of fir wood, which is known as the soundpost, which is perfectly adjusted between the upper cover 25 and the lower cover 26, supported under friction between both covers, acting to prevent deformation of the upper cover and to transmit directly through piece 37 the vibrations of the strings when they are strummed with a bow.

It can, therefore, be seen that the mechanical solution adopted by violin manufactures to solve the deformation effect suffered by the cover 25 of the sound box 24 of the violin, resides in the incorporation of the soundpost 37 and the low-tone bar 36, which solution, although effective, presents the disadvantage of constituting an agent which cannot be modified after the violin has been made. Thus, if a bad sound is obtained, it is impossible to rectify the same.

Figure 12:
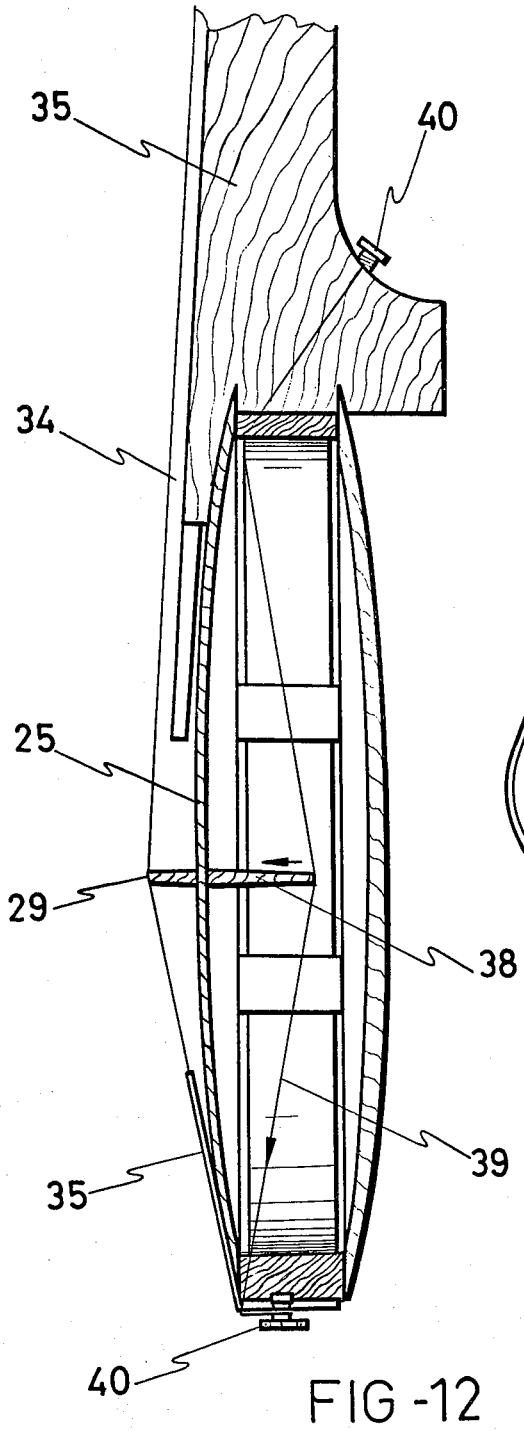
FIG. 12 is a schematic sectional diagram illustrating the improvements according to the present invention.

This disadvantage is overcome by the solution proposed by the present invention which proportions a device, variable at will, acting on the parameters or agents influencing the quality of the sound emitted by the instrument. This device can clearly be seen in FIG. 12, illustrating the similarity between this device and that for improving the sound in guitars.

Instead of the low-tone bar 36, there is placed in the interior of the violin a wooden pivot 38 which, by means of a string 39, exerts a force on the upper cover 25, which force has an inverse direction to that which it supports due to the force of the instrument. This force can be varied at will by means of a conventional tightening device 40. In this way, depending on whether the string 39, which acts on the interior pivot 38, is more or less tightened, the pivot will exert on the upper cover 25 a pressure having an opposite effect to that produced by the strings, consequently modifying at will the deformation of the upper cover 25, even cancelling such deformation. This variation in tension in the upper cover 25 varies the frequency of vibration thereof, since it is acted upon and, consequently, the sonority curve corresponding to the instrument. Magnificent violins can be obtained therewith, the construction whereof need not depend on insoluble uncertain conditions, once constructed.

Non-essential accessory details and other constructional characteristics, such as the location and quality of the tightening device, the constitution thereof, as well as the characteristics of the string, used in carrying out the ideas of this invention, shall be independent of the scope of this invention.

I claim:

1. In a stringed instrument such a guitar or the like having a sound box including an upper cover, a bridge fastened to an outer surface of said upper cover and supporting strings, and means for adjusting the tension of said strings by imparting thereto tension forces in a direction longitudinally thereof, with the result that such tension forces on said strings generate a force on said bridge tending to deform said upper cover, the improvement of means for counteracting said force and eliminating such deformation, said counteracting and eliminating means comprising:

an auxiliary bridge fixed to an inner surface of said upper cover at a position aligned with said bridge fixed to said outer surface thereof;

means for imparting to said auxiliary bridge an auxiliary tension force parallel to and in the same direction as said tension force on said strings; and the product of said auxiliary tension force and the distance from said upper cover to the position at which said auxiliary tension force acts on said auxiliary bridge equaling the product of said tension forces on said strings and the height of said bridge from said strings to said upper cover, such that the resultant of said tension forces on said strings and said auxiliary tension force on said auxiliary bridge acts along the plane of said upper cover parallel to and in the same direction as said tension forces and said auxiliary tension force.

2. The improvement claimed in claim 1, wherein said auxiliary tension force imparting means comprises a rod extending into said sound box and acting on said auxiliary bridge at said position, and means exterior of said sound box for adjusting the extent to which said rod extends into said sound box and therefore the magnitude of said auxiliary tension force.

3. The improvement claimed in claim 1, wherein said auxiliary tension force imparting means comprises a string attached to said auxiliary bridge at said position and extending through and from said sound box, and means exterior of said sound box for adjusting the tension on said string and thus the magnitude of said auxiliary tension force.

* * * * *